US005459888A

United States Patent [19]

Chen

[11] Patent Number: 5,459,888

[45] Date of Patent: Oct. 24, 1995

[54] BATHTUB

[76] Inventor: Ching-Shu Chen, 110 Nan-Sing Road, Yung-Kang City, Tainan Shien, Taiwan

[21] Appl. No.: 342,168

[22] Filed: Nov. 18, 1994

[51] Int. Cl.[6] ..... A47K 3/02

[52] U.S. Cl. ..... 4/593; 4/594

[58] Field of Search ..... 4/584, 592, 593, 4/594, 595

[56] References Cited

U.S. PATENT DOCUMENTS

| | | | |
|---|---|---|---|
| 2,305,846 | 12/1942 | Coordes | 4/593 |
| 2,841,795 | 7/1958 | Pelicano | 4/592 |
| 4,551,869 | 11/1985 | Whitney | 4/592 |

FOREIGN PATENT DOCUMENTS

| | | | |
|---|---|---|---|
| 0281957 | 9/1988 | European Pat. Off. | 4/594 |
| 0500376 | 2/1939 | United Kingdom | 4/594 |

*Primary Examiner*—Robert M. Fetsuga

[57] ABSTRACT

A bathtub comprising a bathtub body having two rows of spaced join posts at two lengthwise opposite edges of the bottom reinforced with crossing ribs, locating feet standing on the floor of a bathroom and fitting with the join posts of the bathtub body for supporting the bathtub body, a protective plate fixed vertically beside the lengthwise side of the bathtub body and having fixing posts fitting with locking tubes with which sidewise posts provided on the locating feet also fits so that the bathtub body may be positioned firmly, with hollow space under it being for easy affix of a drain tube with thee bathtub body.

3 Claims, 4 Drawing Sheets

BATHTUB

BACKGROUND OF THE INVENTION

This invention concerns a bathtub, particularly one provided with a reinforced bottom and join posts to combine with locating feet for supporting the bathtub on the floor of a bathroom, and locking tubes connecting the locating feet with fixing posts of a vertical protective plate fixed beside the bathtub, speeding fixing work of the bathtub without using bricks or mortar. tar.

A known conventional bathtub shown in FIG. 1, comprises a tub body 10 having an upper flange 11. A hollow space 12 has to be prepared in the bathroom by laying bricks with mortar and then the bathtub 10 is deposited therein, with the flange 11 supported on the bricks, and then kept horizontal with mortar filled under the bottom of the tub body 10. And bricks have to be laid beside the lengthwise side of the bathtub and covered with mosaics for beautifying its outer appearance.

SUMMARY OF THE INVENTION

An object of this invention is to offer a kind of bathtub possible to be set without using bricks, mosaics or mortar and to have a smooth outer look, saving both time and labor.

Another object is to offer a bathtub having a reinforced bottom strong enough for enduring the weight of a bather therein.

A main feature of this invention is the bottom of a bathtub provided with crossing reinforcing ribs and join posts provided on the bottom to combine with locating feet standing on the floor of a bathroom for supporting the bathtub, and an extra vertical protective plate fixed beside the bathtub and having fixing posts sideways fitting with locking tubes which also fit with sidewise posts of the locating feet so that the bathtub may be positioned securely.

DETAILED DESCRIPTION OF THE INVENTION

Figure 1:
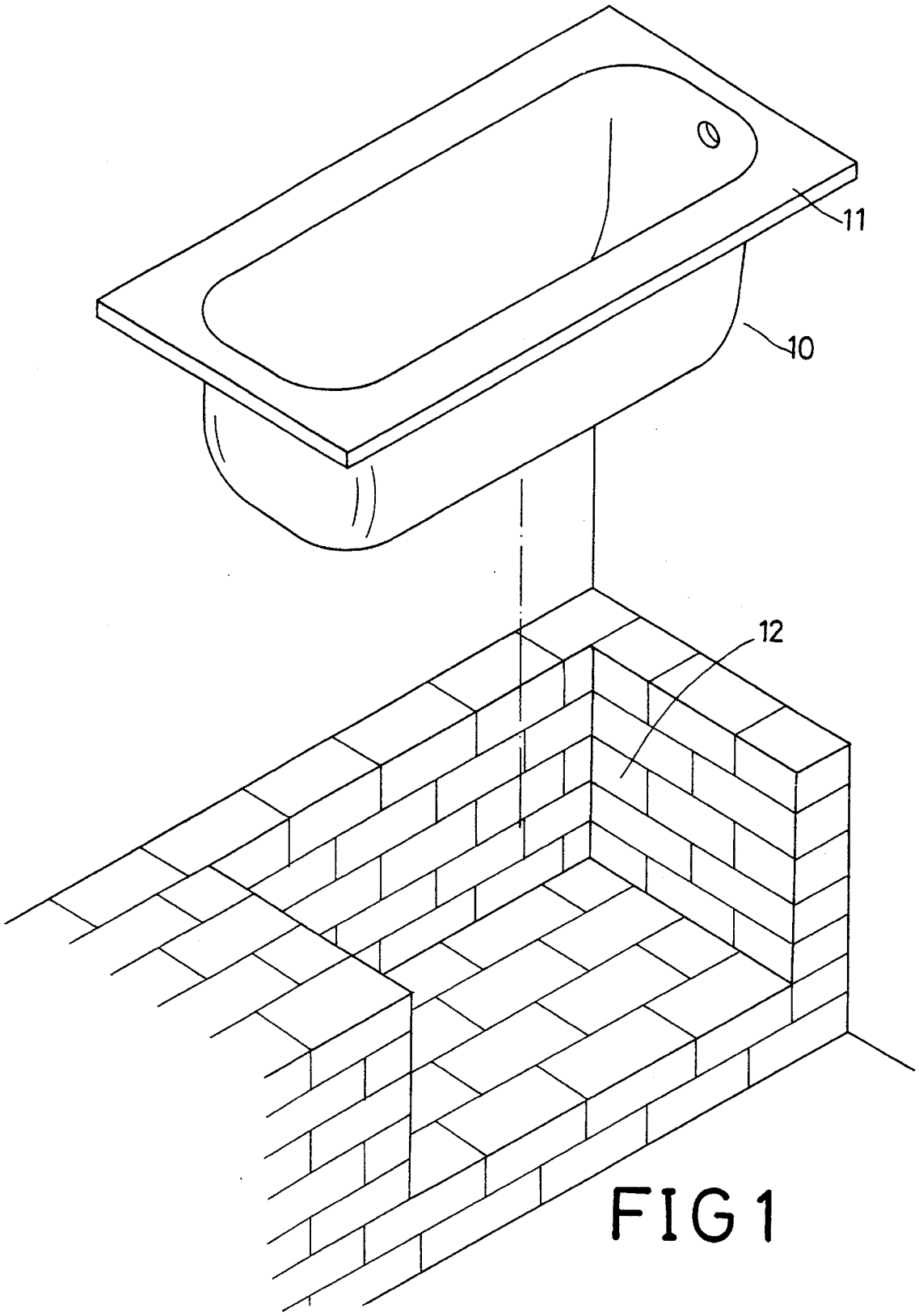
FIG. 1 is a perspective view of a known conventional bathtub.
Figure 2:
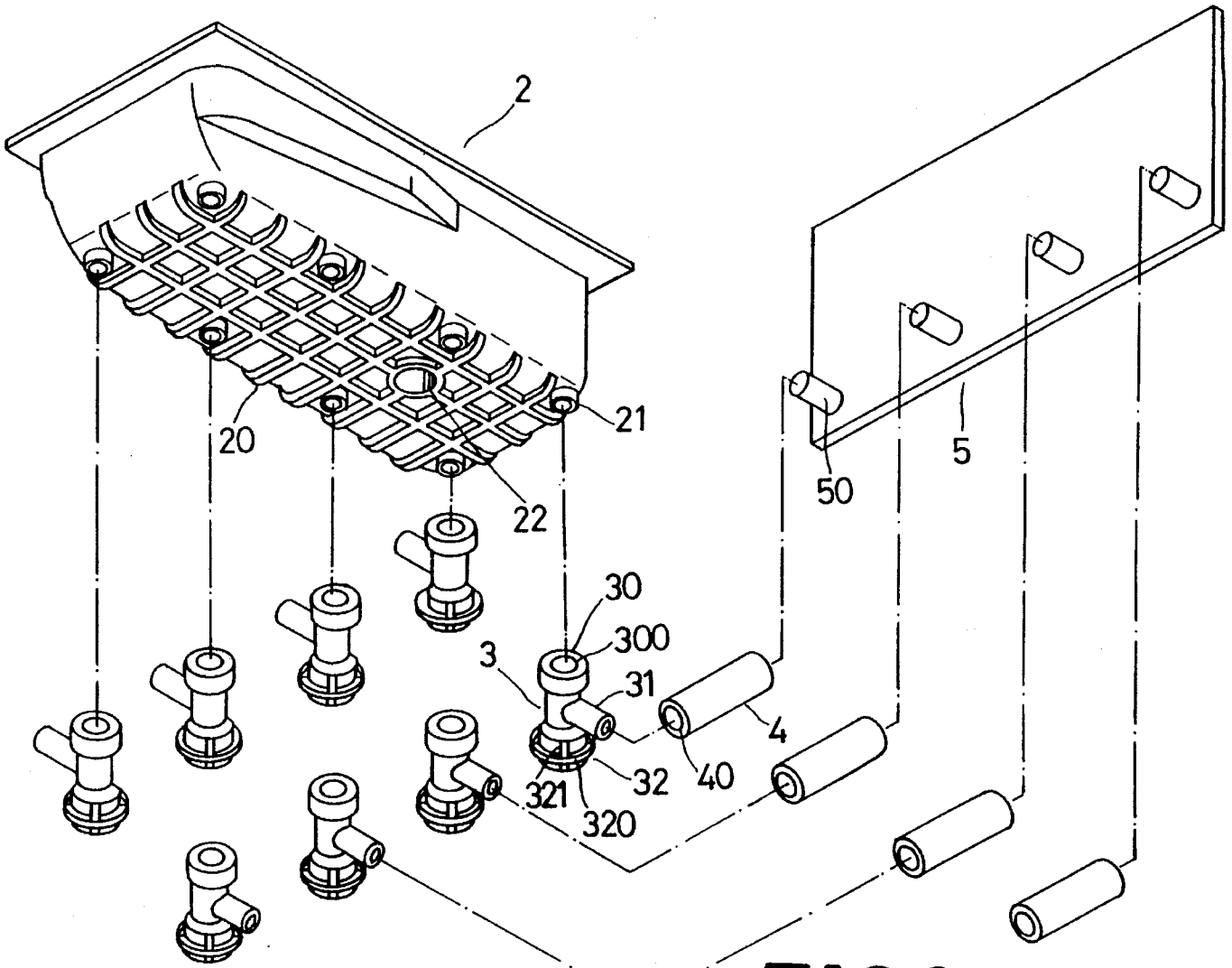
FIG. 2 is an exploded perspective view of a bathtub in the present invention.

A bathtub in the present invention, as shown in FIG. 2, comprises a bathtub body 2, a plurality of locating feet 3, a plurality of locking tubes 4, and a protecting plate 5 combined together.

The bathtub body 2 has a reinforced bottom 20 having a plurality of ribs crossing one another, a plurality of join posts 21 provided spaced apart at two lengthwise opposite edges of the bottom 20, and a drain 22 near the center portion of the bottom 20.

The plurality of locating feet 3 respectively combine with the join posts 21, respectively having an upper tubular portion 30 with a center hole 300 for each join post 21 to fit therein, a sidewise post 31 extending sideways from an intermediate portion, a bottom tubular portion 32, a reinforcing annular ridge 320 provided around the bottom tubular portion 32, a plurality of ribs 321 provided spaced around the bottom tubular portion 32 on and under the annular ridge 320.

The plurality of locking tubes 4 are respectively combined with the sidewise posts 31 of the locating feet 3, having a center hole 40 for the sidewise post 31 of each of the locating feet 3 to fit therein and also for each sidewise post a fixing post 50 provided on the protecting plate 5 to fit therein.

The protective plate 5 is to be deposited longitudinally and vertically beside the bathtub body 2, having the same number of fixing posts 50 as the join posts 21 of the bathtub 2, each post 50 extending from a lower lengthwise portion in a horizontal straight line and spaced apart equidistantly and fitting in the center hole 40 of each locking tube 4.

Figure 3:
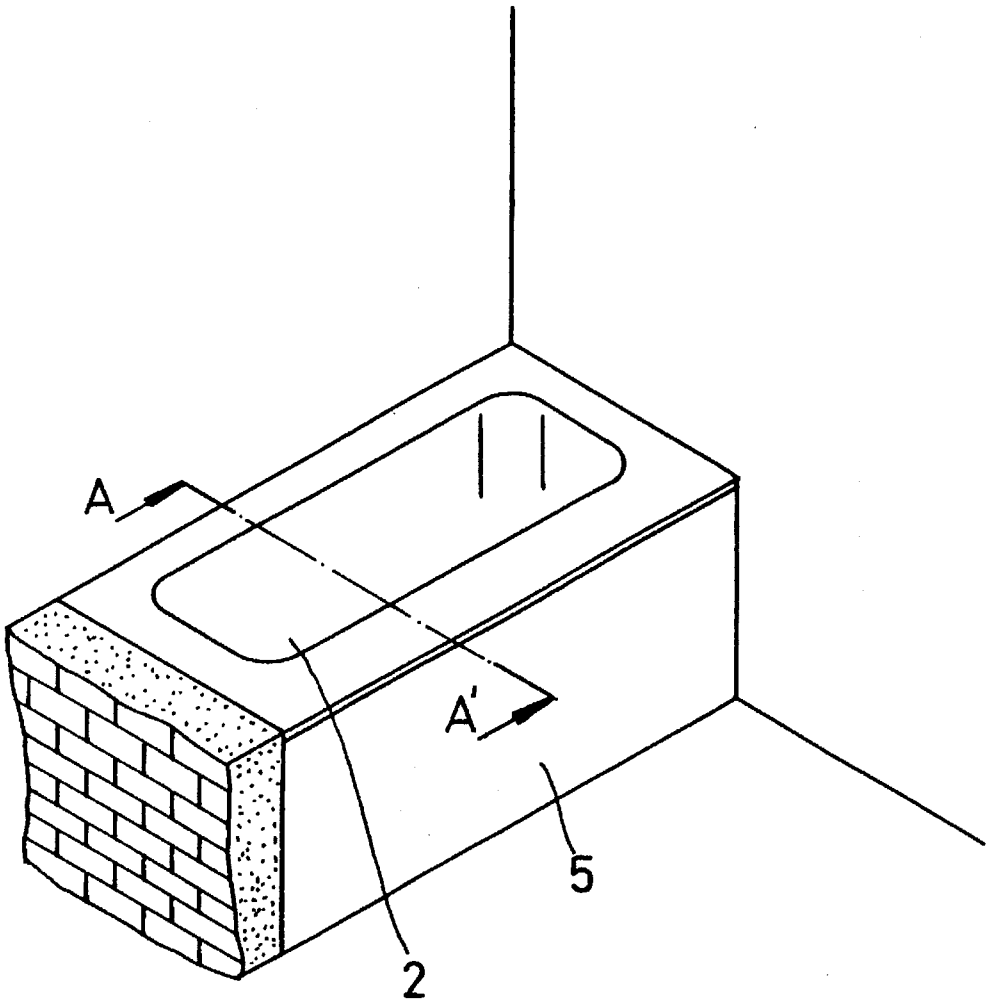
FIG. 3 is a perspective view of the bathtub in the present invention, being fixed on the floor of a bathroom.
Figure 4:
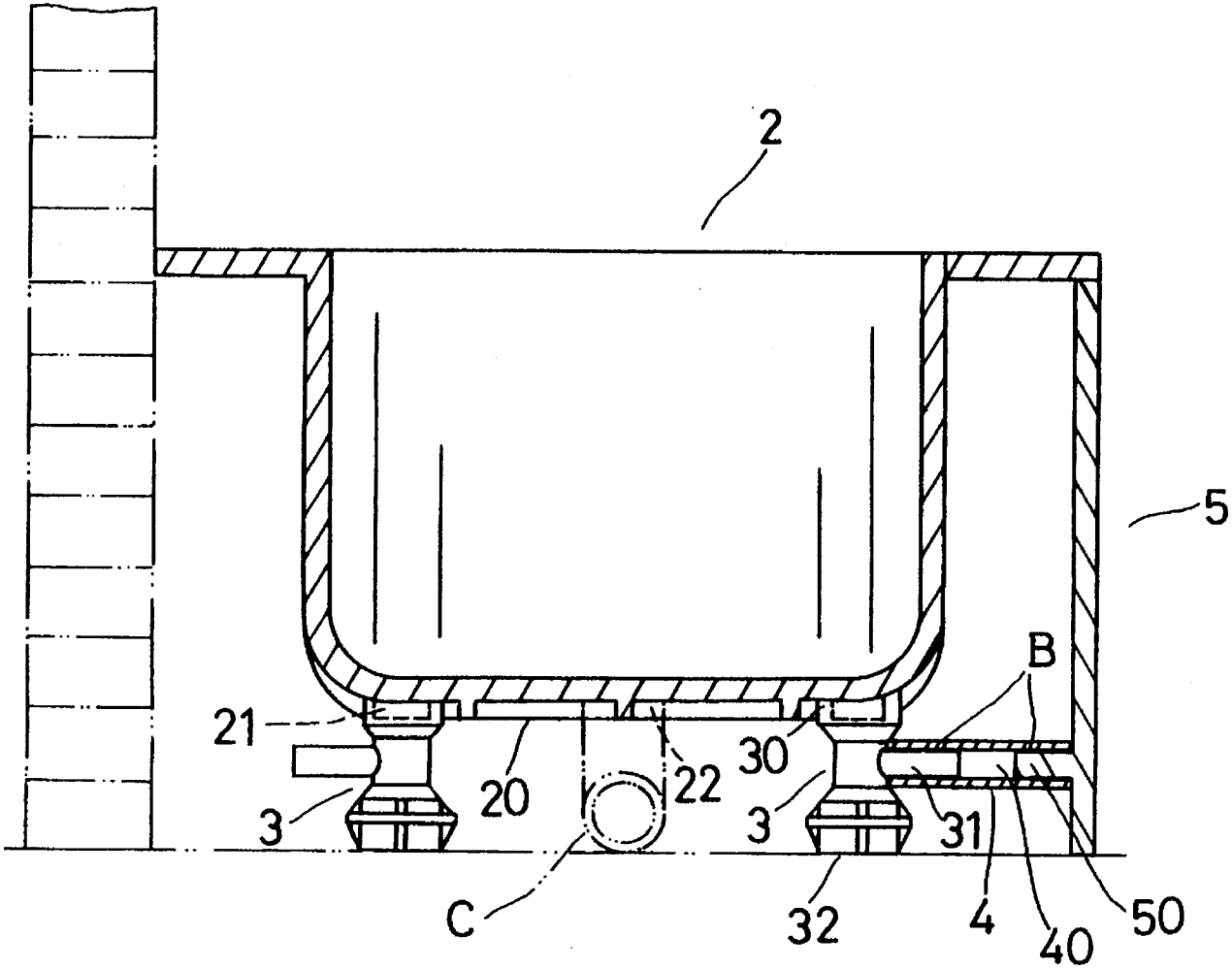
FIG. 4 is a cross-sectional view of line A—A in FIG. 3.

In fixing the bathtub of the present invention, referring to FIGS. 2, 3 and 4, firstly, the join posts 21 of the bathtub body 2 are made to fit in the holes 300 of the tubular portion 30 of the locating feet 3, with the sidewise posts 31 of the locating feet 3 facing outward. Next, the bathtub body 2 is placed at a suitable position in a bathroom, and the locking tubes 4 are made to fit with the sidewise posts 31 and the fixing posts 50 of the protective plate 5 at the same time. And it is better to coat a layer of adhesive on the posts 31 and the fixing posts 50 before they are fitted with the locking tubes 4 so that they can be joined more tightly and securely together, without process with mortar and laying of mosaics, which can not only save time and labor, but also simplify affixing work of a drain tube to the bathtub owing to the hollow space under the bathtub body 2 and separated by the the protective plate 5.

So it can be understood that the bathtub of the present invention has advantages as follows.

1. It can be fixed easily and quickly, without need of using mortar and laying mosaics, saving time and labor.
2. It has a reinforced bottom to endure more weight than conventional ones.
3. A hollow space can exist under it, which is very convenient for affixing a drain tube to it.

What is claimed is:

1. A bathtub comprising:

a bathtub body having a reinforced bottom with a plurality of crossing ribs, and a plurality of join posts extending from two lengthwise opposite edges and spaced apart equidistantly;

a plurality of locating feet respectively fitting with the join posts of said bathtub body, each of said locating feet having an upper tubular portion with a center hole for each said join post to fit therein, a sidewise post extending sidewise from an intermediate portion, and a lower tubular portion to stand on a floor;

a plurality of locking tubes provided to respectively have a center hole for each said sidewise post of said locating feet to fit therein at one end; and a protective plate fixed vertically beside said bathtub body and having a plurality of fixing posts extending from a lower lengthwise portion to fit in the center holes of said locking tubes at the opposite ends thereof.

2. The bathtub as claimed in claim 1, wherein each said lower tubular portion of said locating feet has a reinforcing annular ridge and a plurality of ribs on and under the annular ridge spaced apart equidistantly.

3. The bathtub as claimed in claim 1, wherein said sidewise posts of said locating feet and said fixing posts of said protective plate have their outer surface coated with a layer of adhesive for joining them with said locking tubes together firmly before they are fitted with one another.

* * * * *